United States Patent [19]

Blain

[11] Patent Number: 4,611,975

[45] Date of Patent: Sep. 16, 1986

[54] SCROLL TYPE COMPRESSOR OR PUMP WITH AXIAL PRESSURE BALANCING

[75] Inventor: Edward S. Blain, Rockford, Ill.

[73] Assignee: Sundstrand Corporation, Rockford, Ill.

[21] Appl. No.: 774,707

[22] Filed: Sep. 11, 1985

[51] Int. Cl.[4] ..... F01C 1/04; F01C 11/00

[52] U.S. Cl. ..... 418/5; 418/55; 418/57

[58] Field of Search ..... 418/5, 55, 57

[56] References Cited

U.S. PATENT DOCUMENTS

| | | | |
|---|---|---|---|
| 3,600,114 | 8/1971 | Dvorak et al. . | |
| 3,874,827 | 4/1975 | Young . | |
| 3,884,599 | 5/1975 | Young et al. . | |
| 3,924,977 | 12/1975 | McCullough . | |
| 3,986,799 | 10/1976 | McCullough | 418/57 |
| 3,994,633 | 11/1976 | Shaffer . | |
| 3,994,636 | 11/1976 | McCullough et al. . | |
| 4,065,279 | 12/1977 | McCullough . | |
| 4,216,661 | 8/1980 | Tojo et al. . | |
| 4,350,479 | 9/1982 | Tojo et al. . | |
| 4,357,132 | 11/1982 | Kousokabe . | |
| 4,365,941 | 12/1982 | Tojo et al. . | |
| 4,384,831 | 5/1983 | Ikegawa et al. | 418/57 |
| 4,389,171 | 6/1983 | Eber et al. . | |
| 4,432,708 | 2/1984 | Hiraga et al. . | |
| 4,475,874 | 10/1984 | Sato . | |

FOREIGN PATENT DOCUMENTS

| | | | |
|---|---|---|---|
| 980737 | 1/1951 | France | 418/55 |

*Primary Examiner*—John J. Vrablik

*Attorney, Agent, or Firm*—Wood, Dalton, Phillips Mason & Rowe

[57] ABSTRACT

The problem of axial deflection of scrolls having interfitting vanes in a scroll type apparatus acting as a compressor or a pump due to elevated pressure at the interface between the scrolls is avoided by creating a low pressure zone in a chamber at the interface.

9 Claims, 3 Drawing Figures

FIG. 1
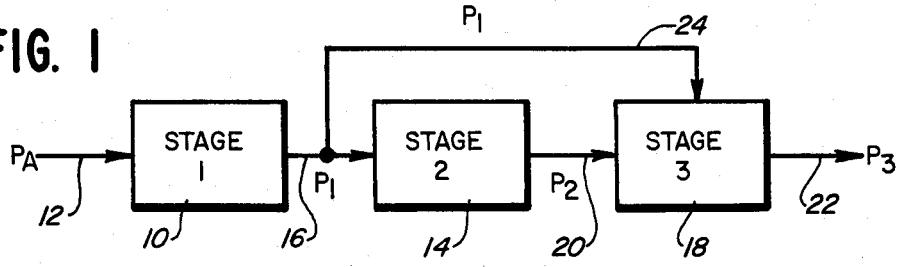
FIG. 2
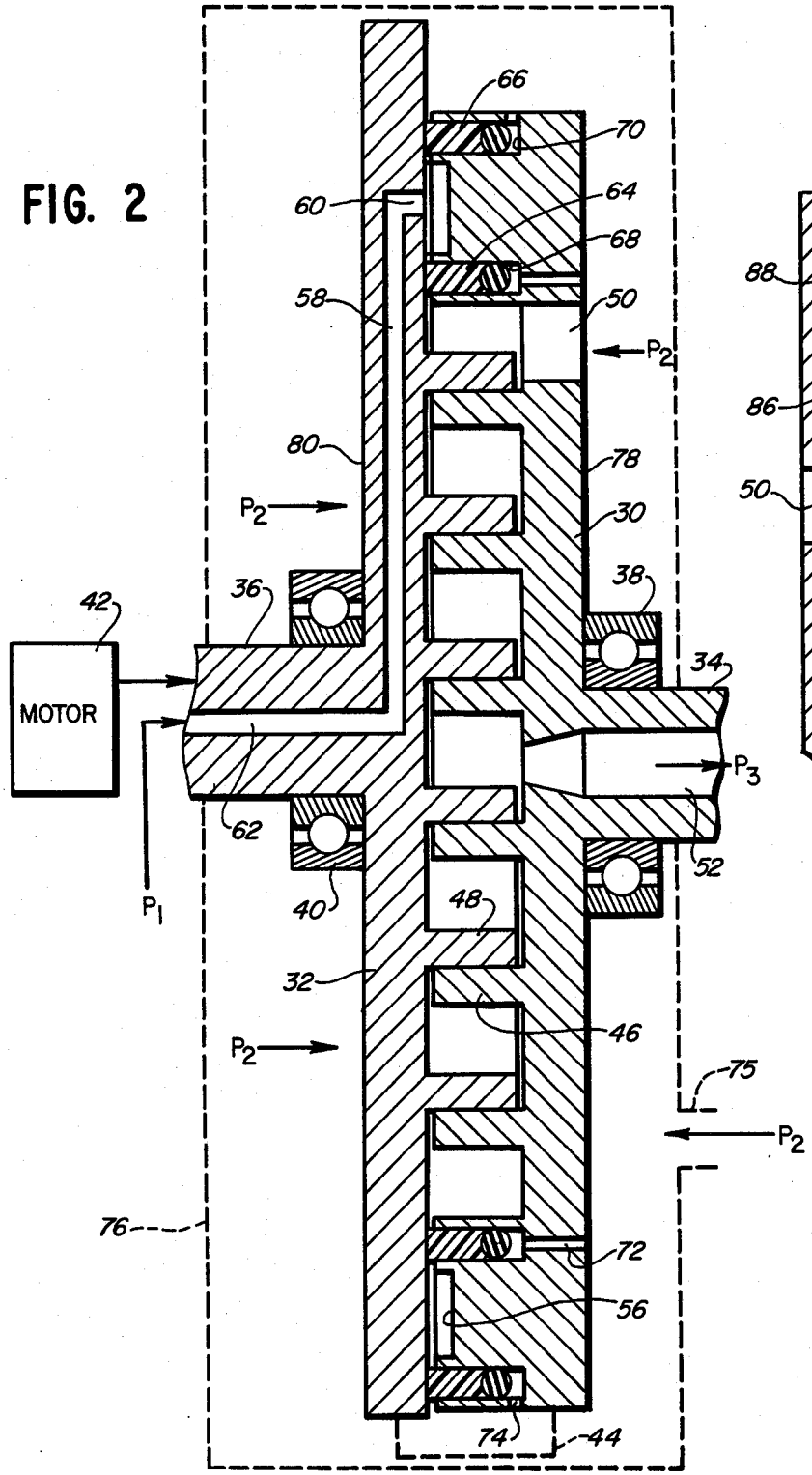
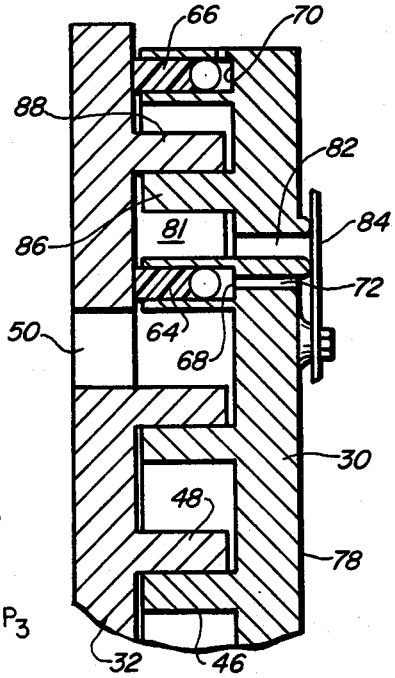
FIG. 3

SCROLL TYPE COMPRESSOR OR PUMP WITH AXIAL PRESSURE BALANCING

FIELD OF THE INVENTION

This invention relates to positive displacement apparatus, and more particularly, to scroll type positive displacement apparatus, particularly when used as a pump or a compressor.

BACKGROUND OF THE INVENTION

Scroll type positive displacement apparatus have attracted a great deal of interest for any of a variety of reasons including theoretical simplicity and, when used as a compressor or pump, the ability to generate very high pressures with an apparatus that physically is quite small, and the fact that they lend themselves to multi-stage configurations.

As is well known, scroll type apparatus are generally comprised of a pair of flat plates in generally parallel relation with each plate having one or more spiral vanes extending axially towards the other plate to interfit with vanes thereon. Depending upon the design, both plates may be rotated with one additionally orbiting with respect to the other or one plate may be merely orbited with respect to the other which is stationary. In either event, closed pockets defined by points of contact of the vanes travel between radially inner and radially outer locations at the interface between the plates and serve to convey fluid between ports disposed at such locations.

When used as a compressor or a pump, the radially outer port will be an inlet port while the radially inner port, frequently formed in a shaft supporting one of the scrolls, is an outlet port. As fluid is conveyed from the inlet to the outlet, the pressure is increased and such an increase in pressure tends to drive the plates axially apart. Should the plates move appreciably apart in the axial direction, the ability to seal the pockets is lost as is the efficiency of operation of the apparatus.

Consequently, the prior art has proposed preloading the plates towards each other in the axial direction. However, when it is desired to start up the preloaded apparatus, the large frictional forces existing at the points of contact between the scrolls make the apparatus hard to start.

To avoid these difficulties, the prior art has proposed the application of the outlet pressure to the side of either or both of the scrolls opposite the interface so that as pressure builds up at the interface during operation of the apparatus, which pressure tends to axially separate the plates, such pressure is also applied on the opposite side of the plate to counter balance the separating pressure.

This approach, while successful, has heretofore lent itself to scroll apparatus of the type where one scroll merely orbits with respect to the other and is not known to be used in those type of scroll apparatus wherein the scrolls both rotate with one scroll additionally orbiting with respect to the other. Furthermore, this approach necessitates the formation of a chamber on the side of at least one scroll remote from the interface which accordingly increases the bulk and axial length of the apparatus.

An example of this approach is illustrated in U.S. Pat. No. 4,384,831, issued May 24, 1983 to Ikegawa et al.

The present invention is directed to overcoming one or more of the above problems.

SUMMARY OF THE INVENTION

It is the principal object of the invention to provide a new and improved scroll type compressor or pump. More specifically, it is an object of the invention to provide such a compressor or pump wherein pressure balancing across one or more scrolls during operation can be achieved without the use of one or more chambers axially opposite of the interface between the scrolls and without excessive preloading.

An exemplary embodiment of the invention achieves the foregoing object in a scroll type positive displacement apparatus which includes first and second scrolls, each having at least one generally spiral vane. The scrolls have their vanes interfitted to define an interface and have pressure responsive surfaces oppositely of the interface. A radially outer port is provided to the interface as is a radially inner port. A bearing mounts at least one of the scrolls and means interconnect the scrolls so that one scroll will orbit relative to the other such that the vanes define closed pockets at the interface which travel between the ports. Means are provided for orbiting the scroll and means including chambers at the interface and isolated from the vanes, the pockets and the ports are provided for creating a low pressure zone whose pressure is less than the pressure at the port.

As a result of this structure, scroll separating forces generated between the ports are compensated for by the action of ambient pressure on the pressure responsive surfaces of the scrolls acting against the low pressure zone.

In a highly preferred embodiment of the invention, the scroll type apparatus is a compressor or pump, the radially inner port is an outlet, and the radially outer port is an inlet.

The invention contemplates the chamber be annular and disposed radially outwardly of the inlet. Seals are provided to isolate the chamber from the remainder of the interface.

According to one embodiment of the invention, the chamber has an inlet port which is adapted to be connected to a pressure source at a level below the pressure at the inlet. The invention contemplates that this embodiment be utilized in a multi-stage system for compressing or pumping with the scroll-type apparatus, as described, being a subsequent stage in the system. The inlet is connected to an immediately preceding stage and the inlet port to the chamber is connected to a stage before the immediately preceding stage to achieve the desired pressure differential.

According to another embodiment of the invention, the low pressure zone creating means comprises a vacuum pump within the chamber and the chamber includes an outlet port along with a check valve for the outlet port.

In a highly preferred embodiment, the vacuum pump is defined by additional, generally spiral interfitting vanes on the first and second scrolls and located within the chamber. In this embodiment, it is preferred that the outlet port be radially inwardly of the additional vanes.

Other objects and advantages will become apparent from the following specification taken in connection with the accompanying drawings.

DESCRIPTION OF THE DRAWINGS

FIG. 1 is a schematic of a multi-stage compressing and pumping system embodying a scroll type apparatus made according to the invention;

FIG. 2 is a sectional view of a scroll type apparatus made according to one embodiment of the invention and which may be applied in the third stage of the multi-stage system shown in FIG. 1; and FIG. 3 is a fragmentary, sectional view of a modified embodiment of the invention.

DESCRIPTION OF THE PREFERRED EMBODIMENTS

Exemplary embodiments of a scroll type apparatus made according to the invention are illustrated in the drawings and FIG. 1 illustrates, schematically, a multi-stage compressing or pumping system in which the same may be used. A first stage 10 has an inlet 12 in fluid communication with atmospheric pressure $P_A$ and provides fluid at an elevated pressure $P_1$ to a second stage 14 as indicated by an arrow 16. The second stage 14 further increases the pressure of the fluid and provides the same to a third stage 18 as illustrated by an arrow 20. The pressure is at a level $P_2$ when applied to the third stage 18. The fluid exits the third stage at a further elevated pressure $P_3$ as indicated by an arrow 22.

In multi-stage compressing or pumping systems of this sort, the value of $P_3$ may be several thousands of pounds per square inch and this creates the axial separation difficulty alluded to previously.

FIG. 1 also illustrates an additional line of fluid communication designated by an arrow 24. This line of fluid communication may be utilized with one embodiment of the invention to be described in greater detail hereinafter. For present purposes, it is sufficient to say that the line designated by the arrow 24 connects with the outlet of stage 1 and provides a source of relatively low pressure fluid, at pressure $P_1$ to the third stage for purposes to be seen.

Turning now to FIG. 2, a first embodiment of the invention will be described. The same includes first and second scroll plates 30 and 32, each mounted on a respective shaft 34 and 36, which shafts 34 and 36 are journaled by respective bearings 38 and 40. Thus, as will be appreciated by those skilled in the art, the embodiment illustrated in FIG. 2 is of the type wherein the scrolls not only orbit with respect to each other, but undergo simultaneous rotation at the same time. To this end, a motor 42 is provided to drive the shaft 36 and any one of a variety of known couplings, shown schematically at 44, may be employed to couple the scroll plates 30 and 32 together for simultaneous rotation while allowing one of the scroll plates to orbit with respect to the other.

The scroll plate 30 mounts one or more, axially extending, generally spiral shaped vanes 46 which are directed toward the scroll plate 32. One or more similar vanes 48 are carried by the scroll plate 32 and directed toward the scroll plate 30. As seen in the drawing, the vanes 46 and 48 interfit to define pockets. Vane configurations for achieving this relation are well known and form no part of the present invention.

When used as a compressor or pump, the scroll apparatus is provided with a radially outer inlet 50 which opens to the interface between the scrolls 30 and 32. A radially inner outlet 52 in fluid communication with the interface is likewise provided and may comprise a bore in the shaft 34.

Those skilled in the art will recognize that during operation of the apparatus, the vanes 46 and 48 will define one or more closed pockets which travel from the inlet 50 to the outlet 52 along the interface of the scrolls 30 and 32 to convey fluid, and elevate the pressure thereof, from the inlet 50 to the outlet 52.

Because of the elevation of pressure in the fluid, the pressure will tend to move the scroll plates 30 and 32 axially away from each other, and this in turn will tend to break the sealing contact between the vanes 46 and 48, particularly at the tips, but along the flanks as well.

To counterbalance this force, which exists only during operation, an annular, ring-like chamber 56 is disposed at the interface of the scroll plates 30 and 32 radially outwardly of the vanes 46 and 48 and thus radially outwardly of the inlet 50. The chamber 56 is formed as an axially opening groove in the scroll plate 30 but could take on any number of other configurations.

Within the scroll plate 32 is a radially directed conduit 58 which terminates in an axially directed inlet port 60 in fluid communication with the chamber 56. It will be noted that, due to the relative orbiting movement between the plates 30 and 32, the width of the groove defining the chamber 56 in the radial direction is considerably greater than the width of the port 60 so as to allow the latter to be in fluid communication with the interior groove through all positions of relative movement.

The conduit 58 extends to a conduit 62 in the shaft 36, which, as illustrated in FIGS. 1 and 2, may be connected to the outlet of the first stage 10. As a consequence, the pressure in the chamber 56 will be at $P_1$.

Radially inner and outer annular seals 64 and 66 flank the sides of the chamber 56 to isolate the chamber 56 from the remainder of the interface between the scrolls 30 and 32. The seals 64 and 66 are received in respective grooves 68 and 70 in the plates 30 and the bottom of each of the grooves 68 and 70 may include a small bore 72 and 74 respectively to the exterior of the interfitted scrolls 30 and 32.

The scroll type apparatus shown in FIG. 2 is intended to be used as the third stage 18 (or a subsequent stage) in a multi-stage compressing or pumping system. As a consequence, it will have the pressure $P_2$ applied to the inlet 50. In a typical configuration, the pressure $P_2$ will be directed to the inlet 75 of a housing shown schematically at 76 containing the scrolls 30 and 32 and consequently, the pressure $P_2$ will be acting upon surfaces 78 and 80 of the scroll plates 30 and 32 respectively, which are opposite the interface between the scrolls 30 and 32. At the same time, a reduced pressure level will be present around the periphery of the interfitted scrolls 30 and 32 at the interface by the reason of the application of the lesser pressure $P_1$ to the chamber 58. Consequently, while a large pressure, $P_3$, will be tending to separate the scrolls 30 and 32 centrally thereof, the relatively lower pressure $P_1$ in a chamber 56 will be tending to axially draw the scrolls 30 and 32 together as a result of the intermediate pressure $P_2$ being applied against the surfaces 78 and 80 oppositely of the chamber 56. As a result, pressure balancing is achieved to eliminate the need for heavy preloading of the scrolls 30 and 32 together, frequently accomplished by preloading through the bearings 38 and 40 in prior art designs. At the same time, the need for the provision of separate chambers located to direct pressure against one or both of the surfaces 78 or 80 of the scrolls 30 and 32 is avoided thereby reducing the axial size of the apparatus.

A modified embodiment of the invention is illustrated in FIG. 3 and where like components are used, like reference numerals are applied; and in the interest of brevity, previously described components will not be redescribed. In this embodiment, an enlarged, annular chamber 81 is utilized in lieu of the chamber 56. The chamber 81 is located radially outwardly of the vanes 46 and 48 and includes a radially inner outlet port 82 extending to the surface 78 of the scroll 30. The outlet port 82 is normally closed by a blade like check valve 84.

Within the chamber 81 are additional, generally spiralled vanes 86 and 88, carried respectively by the scroll plates 30 and 32. The vanes 86 and 88 may have the same pitch and direction as the vanes 46 and 48 and thus, during operation, will act to draw fluid from a radially outer location to a radially inner location. However, it is to be specifically noted that the chamber 81 is not provided with an inlet, but only the outlet 82. As a consequence, the vanes 86 and 88 act as a vacuum pump within the chamber 81. Thus, during operation of the apparatus, a relatively low pressure zone is created in the chamber 81 by action of the vacuum pump. This low pressure zone accomplishes the same function in terms of providing pressure compensation against plate separation as the connection of the chamber 56 to a source of relatively low pressure in the embodiment illustrated in FIG. 2.

The check valve 84, of course, prevents back flow of fluid into the chamber 81 while allowing fluid therein to escape.

It should be observed that in the operation of both embodiments, very little energy is required to provide pressure compensation according to the invention. In the embodiment illustrated in FIG. 1, the pressure level $P_1$ required is present in the system in any event as the input pressure to the second stage 14.

In the embodiment illustrated in FIG. 3, because the vanes 86 and 88 act as a vacuum pump, they move very little mass and thus consume very little energy during operation of the system.

From the foregoing, it will be appreciated that the invention provides a scroll type apparatus with pressure compensation that eliminates the need for high preloads heretofore employed to prevent undesirable axial deflection between scrolls. The same also eliminates the need for specially constructed chambers on the sides of one or more of the scrolls 30 or 32 opposite from the interface between the two, thereby providing an apparatus of reduced axial length. It will also be appreciated that the invention can be used in both forms of scroll type apparatus commonly in use, namely, non-rotating but relatively orbiting type scroll apparatus and rotating and relatively orbiting type scroll apparatus.

I claim:

1. A scroll type compressor or pump comprising:

first and second scrolls each having at least one generally spiral vane;

said scrolls having their vanes interfitted to define an interface and having pressure responsive surfaces oppositely of said interface;

a radially outer inlet to said interface;

a radially inner outlet from said interface;

a bearing mounting at least one of said scrolls;

means interconnecting said scrolls so that one scroll will orbit relative to the other so that said vanes define closed pockets at said interface which travel from said inlet to said outlet;

means for orbiting said one scroll; and means including a chamber at said interface and isolated from said vanes, said pockets, said inlet and said outlet, for creating a low pressure zone whose pressure in less than the pressure at said inlet.

2. The scroll type compressor or pump of claim 1 wherein said chamber is annular and disposed radially outwardly of said inlet, and seals isolating said chamber from the remainder of said interface.

3. The scroll type compressor or pump of claim 2 wherein said chamber has an inlet port adapted to be connected to a pressure source at a level below the pressure at said inlet.

4. A multistage system for compressing or pumping and including the scroll type compressor or pump of claim 3 as a subsequent stage in said system which comprises at least three stages, said inlet being connected to an immediately preceding stage and said inlet port being connected to a stage before said immediately preceding stage.

5. The scroll type compressor or pump of claim 2 wherein said creating means comprises a vacuum pump within said chamber and said chamber includes an outlet port, and a check valve for said outlet port.

6. The scroll type compressor or pump of claim 5 wherein said vacuum pump is defined by additional generally spiral interfitting vanes on said first and second scrolls and located within said chamber.

7. The scroll type compressor or pump of claim 6 wherein said outlet port is radially inwardly of said additional vanes.

8. A scroll type positive displacement apparatus comprising;

first and second scrolls each having at least one generally spiral vane;

said scrolls having their vanes interfitted to define an interface and having pressure responsive surfaces oppositely of said interface;

a radially outer port to said interface;

a radially inner port from said interface;

a bearing mounting at least one of said scrolls;

means interconnecting said scrolls so that one scroll will orbit relative to the other so that said vanes define closed pockets at said interface which travel between said ports;

means for orbiting said one scroll; and an annular chamber formed in said scrolls at said interface and wholly between said scrolls, said chamber having an inlet adapted to be connected to a relatively low pressure source, said chamber being sealed from said interface by annular seals.

9. A scroll type positive displacement apparatus comprising;

first and second scrolls each having at least one generally spiral vane;

said scrolls having their vanes interfitted to define an interface and having pressure responsive surfaces oppositely of said interface;

a radially outer port to said interface;

a radially inner port from said interface;

a bearing mounting at least one of said scrolls;

means interconnecting said scrolls so that one scroll will orbit relative to the other so that said vanes define closed pockets of said interface which travel between said ports;

an annular chamber in said scrolls at said interface; said chamber having an outlet and otherwise being sealed about said interface, and additional vanes carried by said first and second scrolls within said chamber and operative to create a vacuum therein.

* * * * *